United States Patent [19]

Kikkawa et al.

[11] 3,972,368

[45] Aug. 3, 1976

[54] METHOD AND APPARATUS FOR AUTOMATICALLY CASTING NON-FERROUS METAL

[75] Inventors: Takahiro Kikkawa; Toshinori Hirata, both of Higashi; Waichi Miyaji, Kawaguchi; Kouichi Tokunaga; Hidetosi Otu, both of Kamagaya; Mikiya Tanigawa; Yasuhiro Yamazaki, both of Hachinohe, all of Japan

[73] Assignees: Hachinohe Smelting Co., Ltd.; Mitsui Kinzoku Engineering Service Co., Ltd.; Mitsui Mining & Smelting Co., Ltd., all of Tokyo, Japan

[22] Filed: Oct. 9, 1974

[21] Appl. No.: 513,290

[30] Foreign Application Priority Data

| | | |
|---|---|---|
| Aug. 8, 1974 | Japan | 49-90915 |
| Aug. 8, 1974 | Japan | 49-90916 |
| Aug. 8, 1974 | Japan | 49-90917 |
| Aug. 8, 1974 | Japan | 49-90918 |
| Aug. 8, 1974 | Japan | 49-90919 |
| Aug. 8, 1974 | Japan | 49-90920 |

[52] U.S. Cl. ..... 164/76; 164/130; 164/131; 164/134; 164/155; 164/269; 164/331; 164/337

[51] Int. Cl.$^2$ ..... B22D 7/00; B22D 9/00; B22D 29/04; B22D 43/00

[58] Field of Search ..... 164/76, 269, 329, 330, 164/331, 134, 129, 130, 4, 154, 155, 131, 344, 335, 337, 412

[56] References Cited

UNITED STATES PATENTS

| | | | |
|---|---|---|---|
| 1,316,471 | 9/1919 | Acton et al. | 164/131 X |
| 3,247,555 | 4/1966 | Keating | 164/337 X |
| 3,498,364 | 3/1970 | Chambran | 164/269 |

FOREIGN PATENTS OR APPLICATIONS

| | | | |
|---|---|---|---|
| 2,036,585 | 12/1970 | France | 164/134 |
| 1,164,036 | 2/1964 | Germany | 164/269 |
| 145,728 | 6/1962 | U.S.S.R. | 164/269 |

*Primary Examiner*—Ronald J. Shore
*Attorney, Agent, or Firm*—Armstrong, Nikaido & Wegner

[57] ABSTRACT

A method comprising the steps of casting molten nonferrous metal ingots, skimming scum foaming on the surface of the molten metal in each mold, cooling the molds to release ingots therefrom, stacking the ingots released from the molds to form ingot stacks each comprising a plurality of layers of ingots arranged in vertically stacked relation alternately in two different patterns, weighing the ingot stacks, and tightly binding the weighed ingot stacks with steel bands. An apparatus adapted to carry out the aforementioned method into practice comprising an automatic casting device for automatically casting molten nonferrous metal in molds to produce ingots, a scum skimming device for skimming scum foaming on the surface of molten metal in each mold, mold cooling means to release ingots from the molds by cooling the ingot, an ingot stack forming device adapted to form ingot stacks on a conveyor, a weighing device for weighing the ingot stacks, and a binding device for binding the ingot stacks weighed by the weighing device.

9 Claims, 20 Drawing Figures

METHOD AND APPARATUS FOR AUTOMATICALLY CASTING NON-FERROUS METAL

This invention relates to a method and an apparatus for automatically carrying out successive steps beginning with casting of zinc or other nonferrous metal ingots and ending with binding of ingot stacks.

In carrying out a series of steps including casting zinc or other nonferrous metal into ingots and binding the ingots for shipment to the market, it has hitherto been customary to carry out the steps individually instead of performing them in a continuous operation. For example, molten metal is obtained by smelting and cast in molds to produce ingots by a casting machine. The ingots produce are piled in a stack and weighed by a weighing device. Finally the stack of ingots is bound with steel band by using a manual binding device or the like. It has only been possible to carry out automatically and continuously the steps of casting ingots and stacking them in a stack. However, difficulty has been encountered in performing the aforementioned series of steps automatically and continuously from beginning to end. Thus, methods and apparatus of the prior art have the disadvantages of requiring more space than is necessary, being low in operation efficiency and needing a lot of human power.

On the other hand, it is essential in casting ingots of nonferrous metal that no scum is incorporated therein and no cracks are formed on their surfaces. Exposure to air of nonferrous metal, particularly lead, zinc aluminum or other nonferrous metal of low melting point, tends to cause formation of scums and to release air bubbles on the surface of ingots produced by casting such metal. Therefore, it is necessary to remove the scums from the surface of each ingot and give a beautiful finish thereto while keeping the volume of each ingot constant. The need to satisfy these requirements adds to the difficulty of carrying out the aforementioned steps automatically and continuously.

This invention has as its object the provision of a method and an apparatus for automatically and continuously carrying out successive steps beginning with casting of ingots and ending with binding of ingot stacks which obviate the aforementioned disadvantages of the prior art and which are effective to produce nonferrous metal ingots of high quality satisfactory for specifications and orders.

Certain terminology will be used in this specification. The term "ingot stack" will refer to a stack of ingots comprising a plurality of layers of ingots arranged in vertically stacked relation.

Additional and other objects and advantages of the invention will become evident from the description set forth hereinafter when considered in conjunction with the accompanying drawings, in which.

Figure 8A:
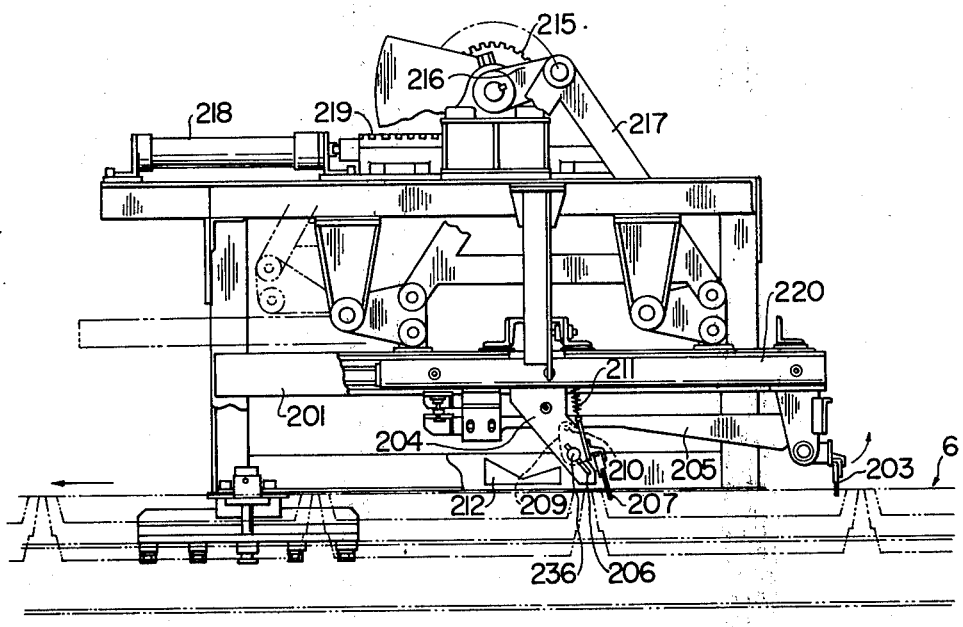
Figure 8B:
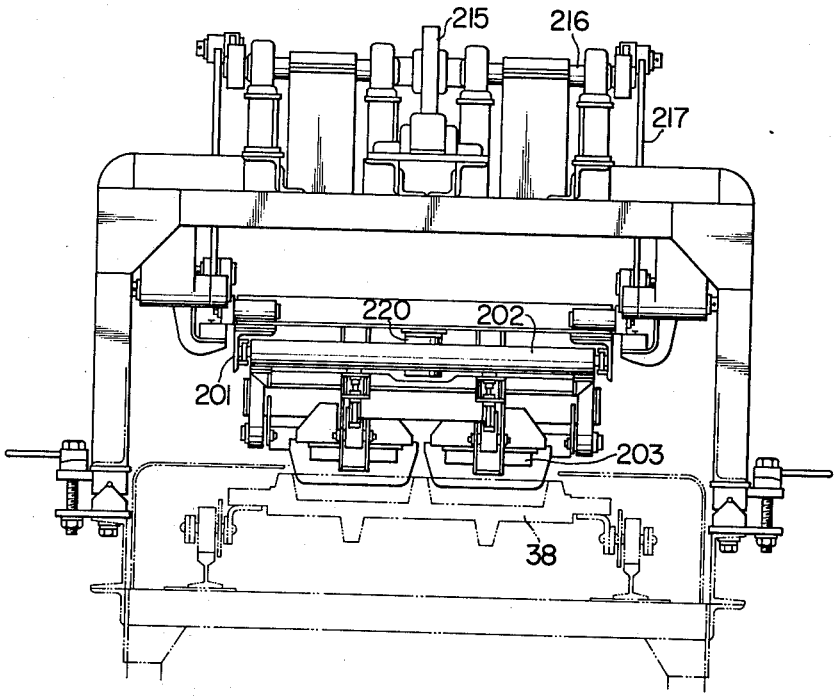

FIG. 8*a* is a front view of the automatic scum skimming device;

FIG. 8*b* is a side view of the device shown in FIG. 8*a;*

Figure 8C:
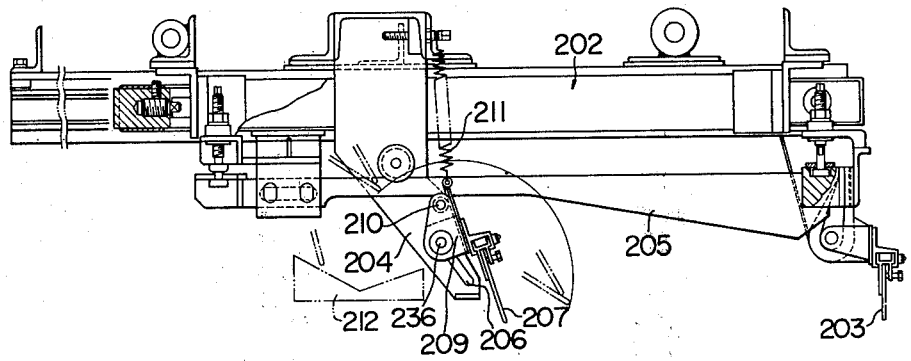
Figure 9:
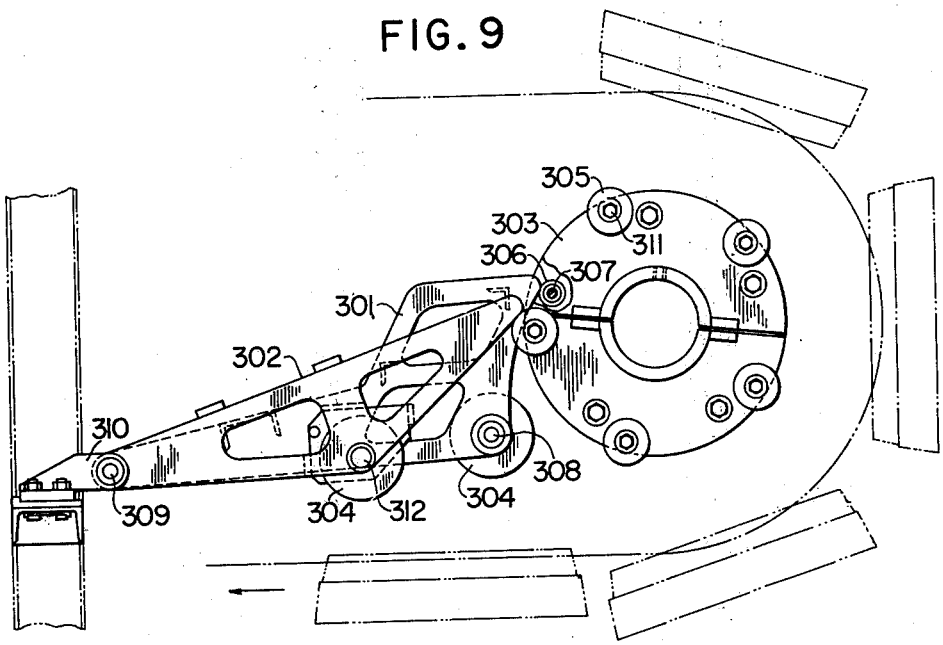
Figure 10:
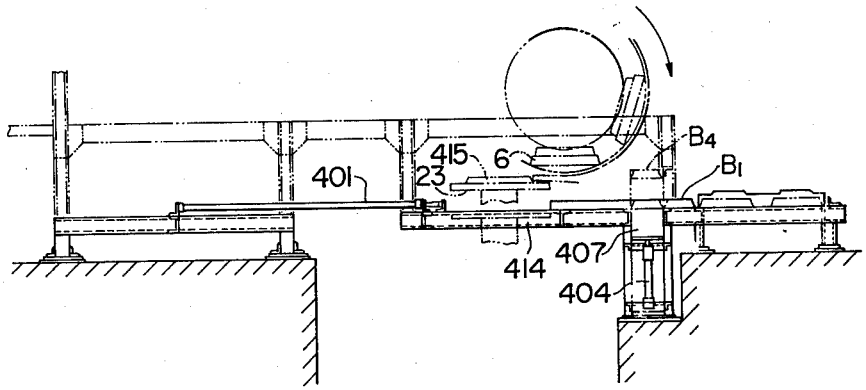
Figure 11:
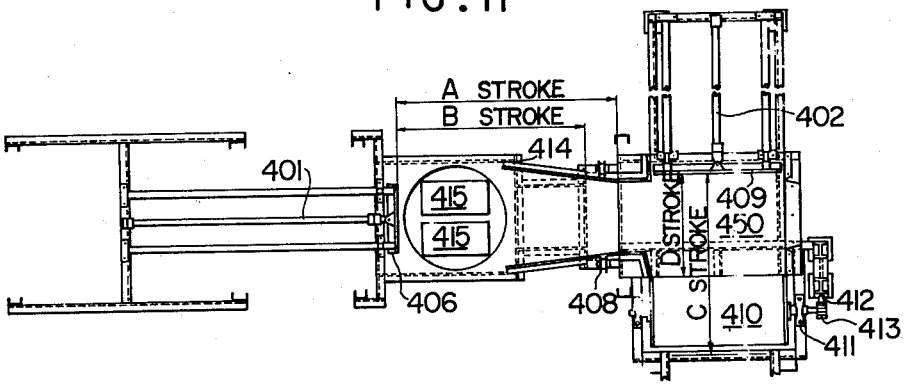
Figure 12:
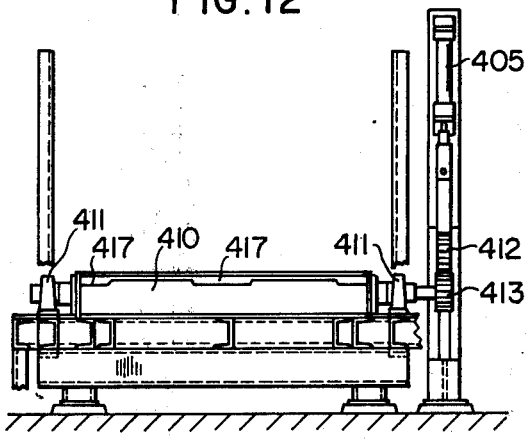
Figure 13:
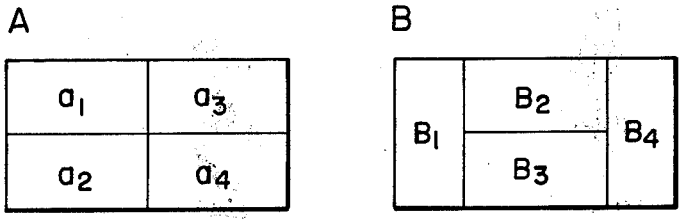
Figure 14:
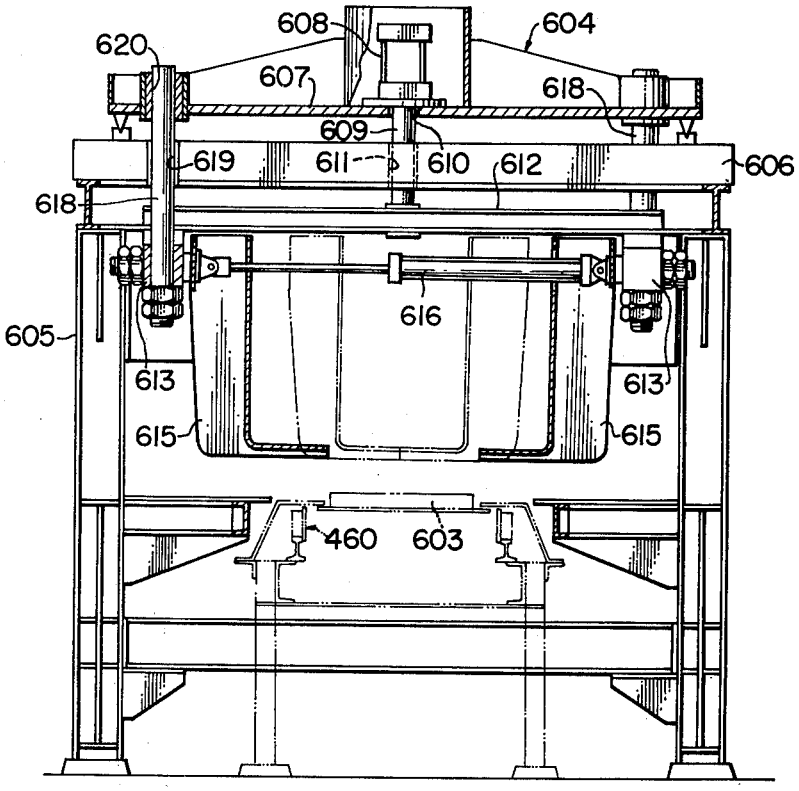
Figure 15:
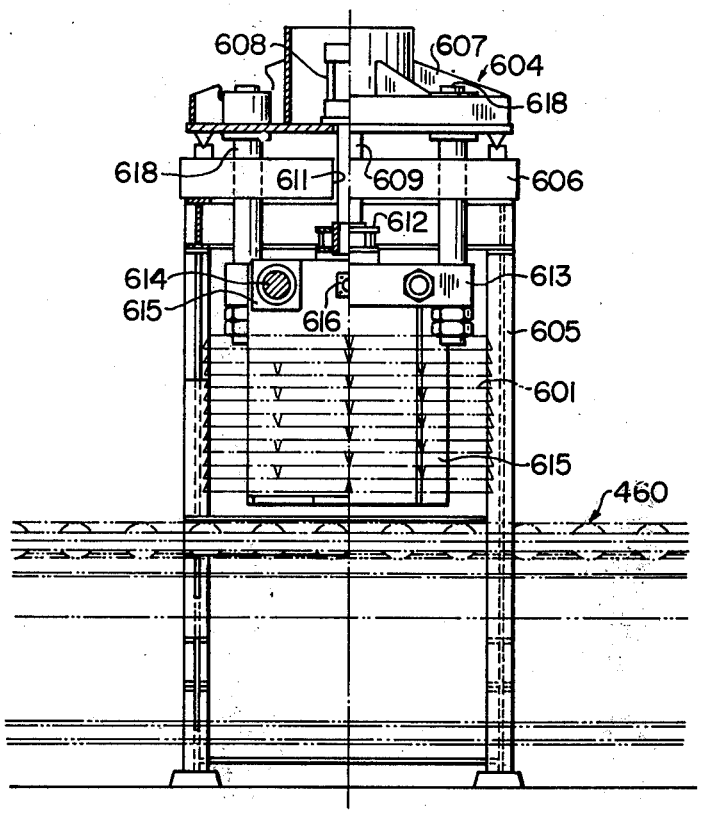
Figure 16:
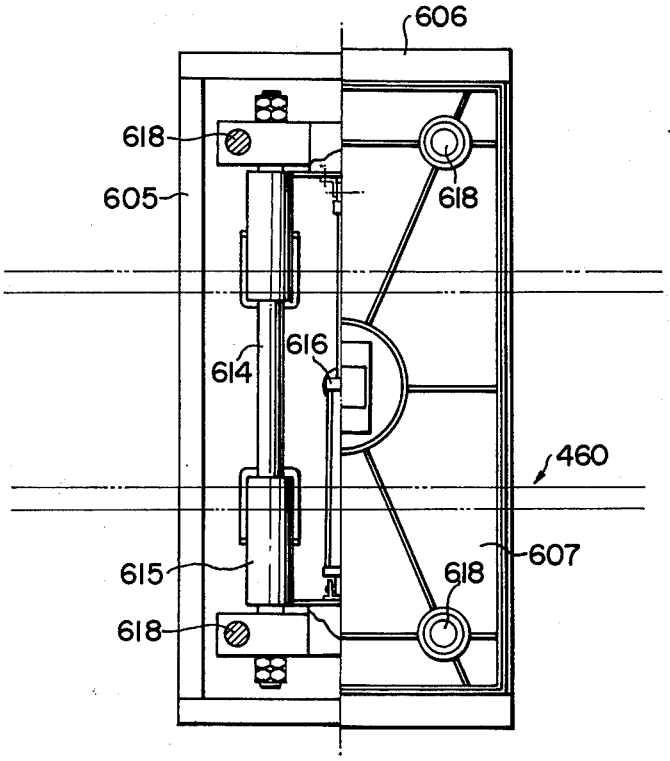

FIG. 8*c* shows the essential portions of the scum skimming device;

FIG. 9 is a front view of the hammering device;

FIG. 10, FIG. 11 and FIG. 12 show the ingot stacking device for forming an ingot stack;

FIG. 13 shows two different patterns in which ingots of each layer of an ingot stack are arranged alternately;

FIG. 14, FIG. 15 and FIG. 16 show the weighing device; and

Figure 17:
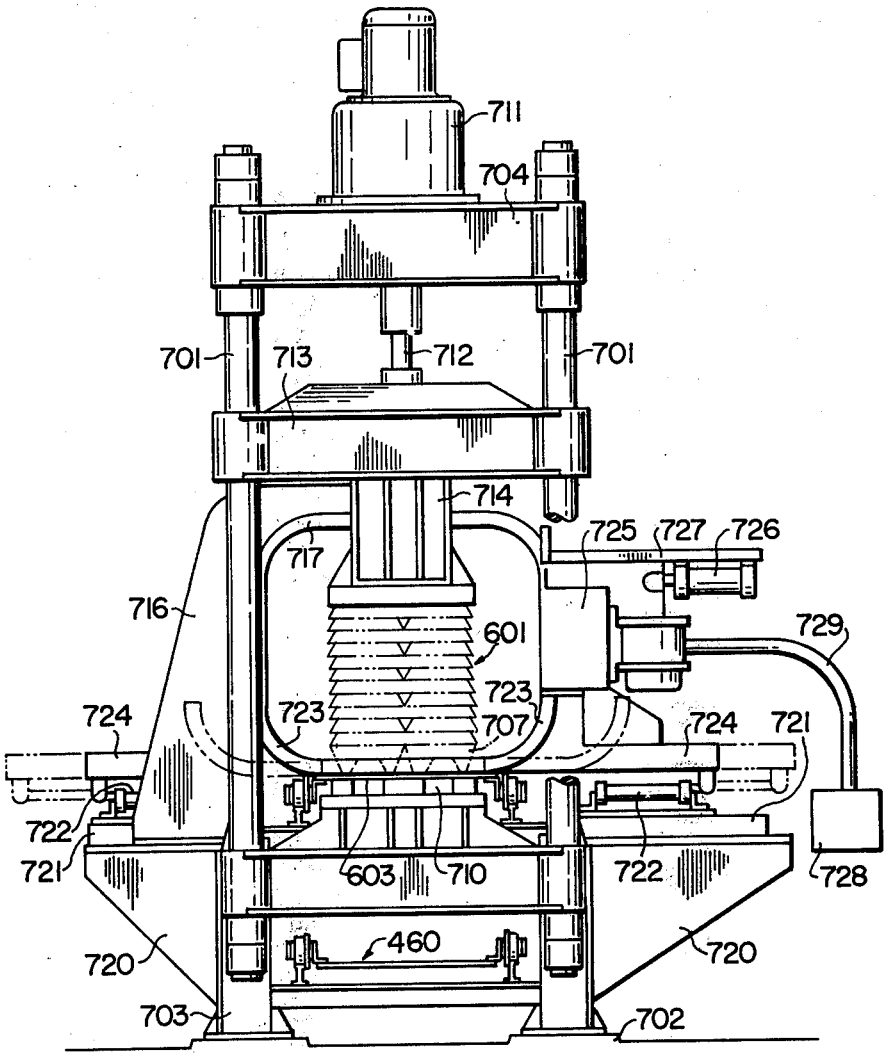
Figure 18:
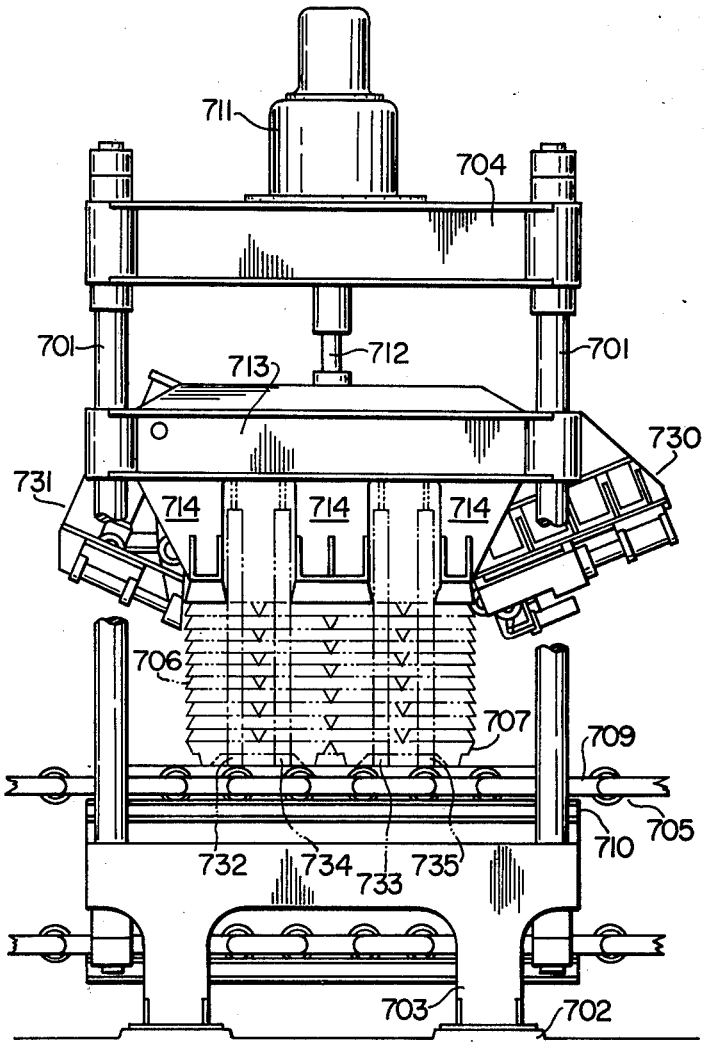

FIG. 17 and FIG. 18 show the binding device.

A preferred embodiment of the invention will now be described with reference to the drawings. The invention will be described as being applied to the casting of metallic zinc ingots.

Figure 1:
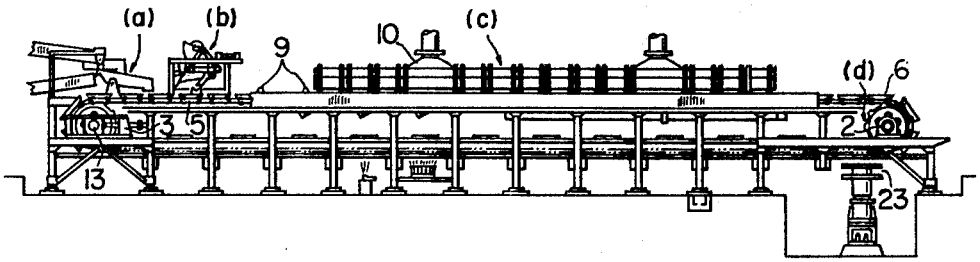
FIG. 1 is a schematic view of the automatic casting device.

Referring to FIG. 1, there is shown an automatic casting machine comprising a chain conveyor 5, a plurality of molds 6 affixed to the chain conveyor 5 and arranged in two rows lengthwise of the conveyor 5 with the molds in each row being equidistantly spaced apart from one another, a device (a) for casting a predetermined volume of molten metal disposed on the head of the chain conveyor 5, an automatic scum skimming device (b) for removing scum from the surface of molten metal cast in each mold 6, forcedly cooling means (c) for forcedly cooling the metal in each mold 6, and a hammering device (d) disposed at the end of the chain conveyor 5 for releasing cooled metal ingots from the molds 6, the adjacent molds 6 of two rows being disposed in side-by-side relation widthwise of the chain conveyor 5 with respect to the hammering device (d).

Figure 2:
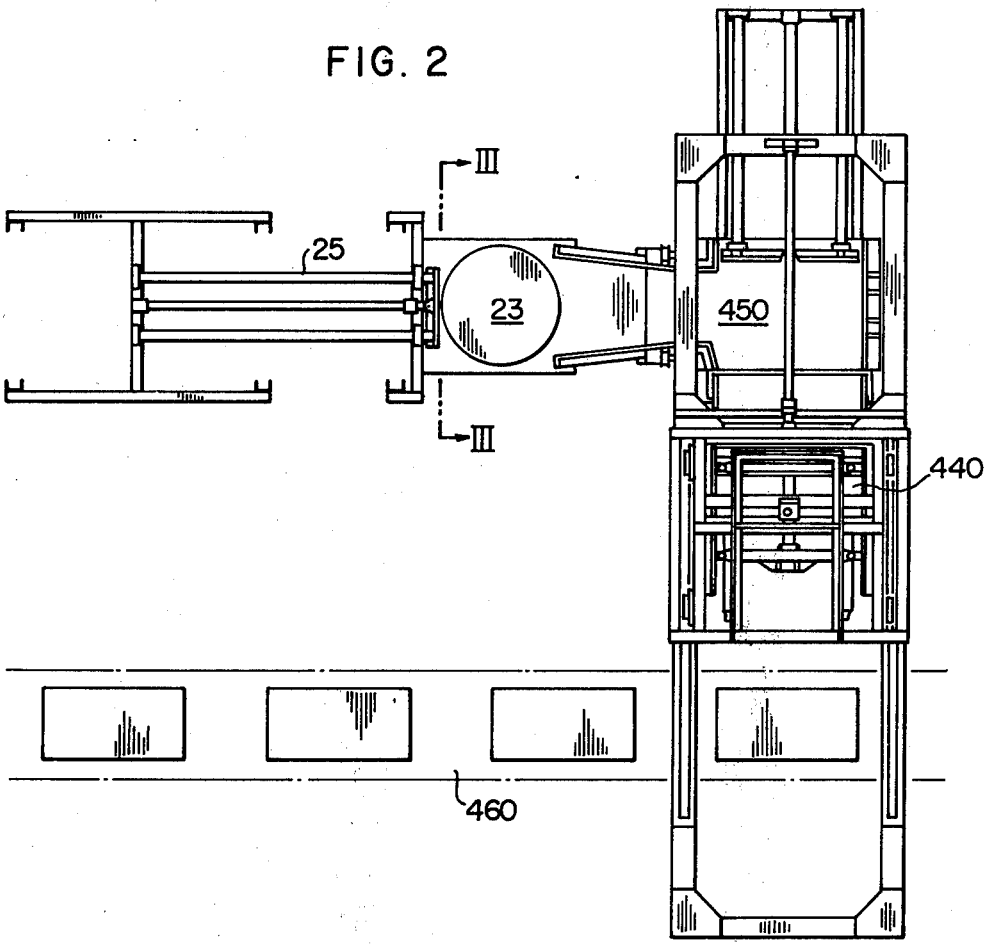
FIG. 2 is a schematic plan view of the ingot stacking device.
Figure 3:
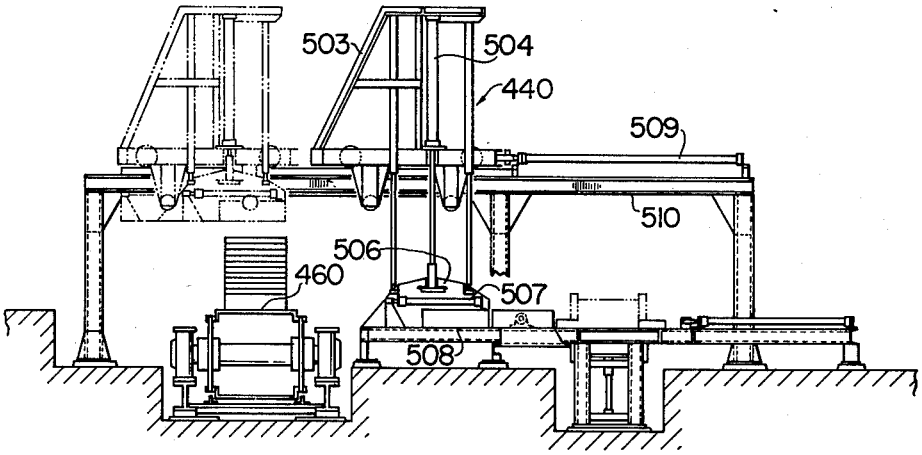
FIG. 3 is a front view of the device shown in FIG. 2.

FIG. 2 and FIG. 3 show an ingot stacking device which is adapted to stack, in two alternate patterns, a plurality of sets of ingots released from the automatic casting machine so as to form ingot stacks. As shown, the ingot stacking device comprises a stacking table 23 adapted to move vertically and at the same time rotate through a predetermined angle, means for moving the ingots on the stacking table 23 to a table 450 after arranging the same in a predetermined pattern, and moving and stacking means 440 for moving each set of ingots supplied from the table 450 to a predetermined position on a discharge conveyor so as to stack a plurality of layers of ingots thereon.

Figure 4:
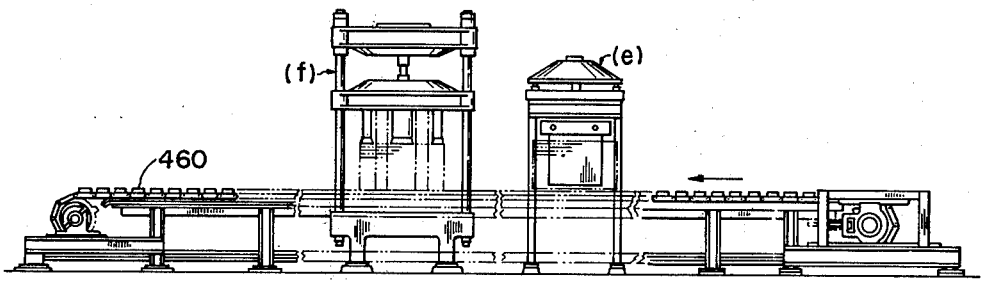
FIG. 4 is a schematic view showing the weighing device and the binding device in relation to the discharge conveyor means.

FIG. 4 shows the discharge conveyor 460, a weighing device (e) for weighing ingot stacks conveyed by the discharge conveyor, and a binding device (f) for binding the ingot stacks. The various steps through which the ingots are processed and the construction of the devices for carrying out the successive steps will now be described in detail.

Figure 5:
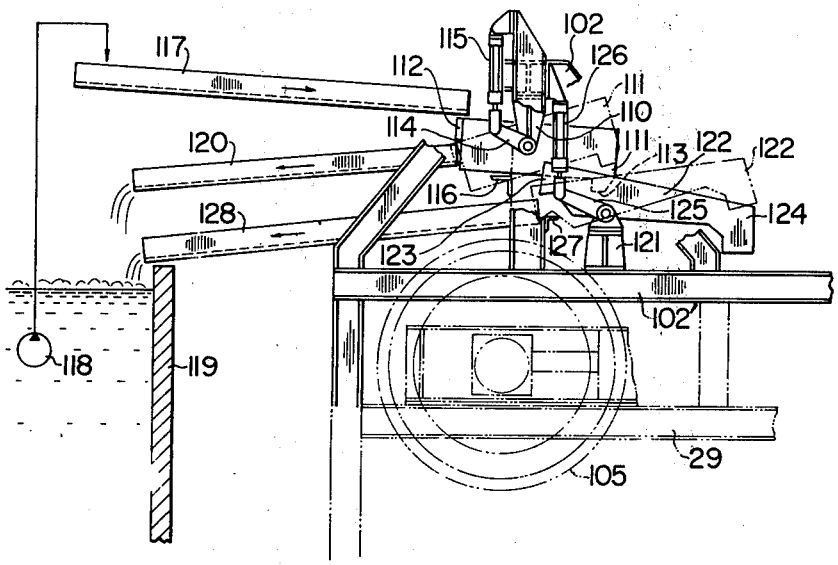
FIG. 5, FIG. 6 and FIG. 7 show the molten metal casting device.
Figure 6:
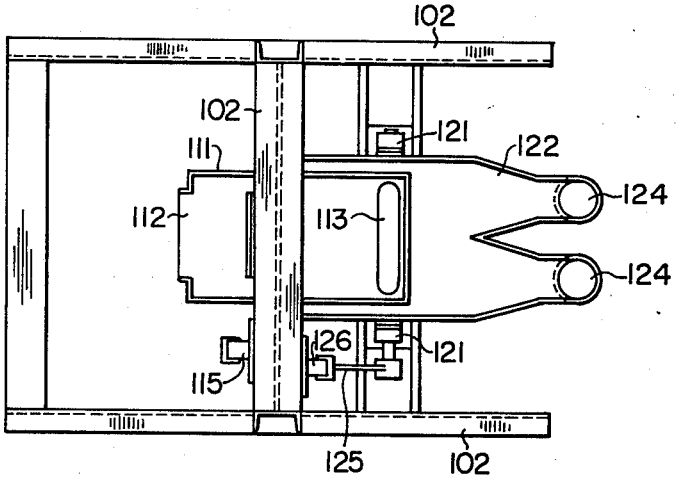
Figure 7:
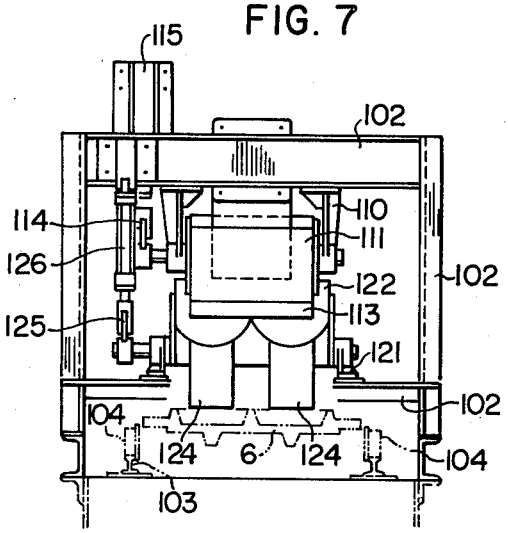

Molten metal produced by smelting or molten zinc of about 500°C in this embodiment is cast in the molds 6 affixed to the chain conveyor 5 by the device for casting a predetermined volume of molten metal (a) whose construction is shown in detail in FIG. 5, FIG. 6 and FIG. 7. As shown, the casting device (a) includes a framework 102, a chain conveyor framework 102' and a sprocket wheel 105 supported by the chain conveyor framework 102' for moving endless conveyor chains 104 of the chain conveyor 5 on the rails 103. Although only one sprocket wheel 105 is shown, the other sprocket chain similar to that shown and described above is set at the other end of the chain conveyor 5. The molds 6 are disposed between the two conveyor chains 104. The mold conveying means of the aforementioned construction does not form a part of the invention and would be obvious to one of ordinary skill in the field of art to which the invention belongs, so that detailed description thereof is omitted. The essential point of the casting device would be that a pair of molds are successively positioned beneath the casting devices (a).

The casting device (a) comprises an intermediate tilted part for skimming and returning (first tilted part) 111 pivotally supported by upper trunnions 110 affixed to the framework 102 for movement about the transverse axis. The first tilting part 111 is formed at its forward end with an overflow opening 112 and at the bottom of its rearward end portion with a discharge port 113, and adapted to be moved, through an arm 114 by a cylinder 115 affixed to the framework 102, between a molten zinc discharge position shown in solid lines and a molten zinc overflow position shown in dash-and-dot lines which is determined when the arm 114 is brought into abutting engagement with a stopper 116.

Molten steel or molten zinc is continuously supplied to the first tilting part 111 through a feeding launder 117. Molten zinc is supplied to the feeder launder 117 from a molten zinc reservoir 119 by means of a molten zinc supply pump 118 of the ordinary type.

There is also provided a first returning launder 120 which is adapted to be brought into index with the overflow opening 112 of the first tilting part 111 when the latter is in the overflow position. The first returning launder 120 is adapted to receive molten zinc and scum through the overflow opening 112 from the tilting part 111 and return the same to the molten zinc reservoir 119.

The framework 102 also has affixed thereto lower trunnions 121 which pivotally support a tilted part for casting (second tilted part) 122 formed at its forward end with an overflow opening 123 and at its rear ward end with two downwardly directed distribution ports 124. The rear ward end portion of the second tilted part 122 is bifurcated, and the distribution ports 124 are each formed at the end of one of the two inclined lines of the letter Y and adapted to be brought into index with a molten zinc pouring port of one of the two molds arranged in side-by-side relation on the chain conveyor 5. The second tilted part 122 is adapted to be moved by a cylinder 126 through an arm 125 between a distribution position or molten zinc pouring position shown in solid lines and an overflow position shown in dash-and-dot lines in which the molten zinc is returned to the molten metal reservoir 119. The overflow position of the second tilted part 122 is determined when the arm 125 is brought into abutting engagement with a stopper 127.

There is also provided a lower second returning launder 128 which is adapted to return the molten zinc to the molten zinc reservoir 119 when the second tilted part 122 is in its overflow position.

The operation of the casting device (a) will now be described. The second tilted part 122 is initially disposed in its overflow position shown in dash-and-dot lines and the first tilted part 111 is initially disposed in its discharge position shown in solid lines. Since molten zinc is continuously supplied from the molten zinc reservoir 119 by the pump 118 to the first tilted part 111 through the feeding launder 117, the molten zinc flows through the discharge port 113 formed in the first tilted part 111 into the second tilted part 122. The molten zinc thus introduced into the second tilted part 122 in its overflow position remains in a predetermined volume in a bottom portion of the second tilted part 122 and the remainder is returned to the molten reservoir 119 through the second lower returning launder 128. Thus, the molten zinc of the predetermined volume remaining in the bottom portion of the second tilted part 122 contains almost no scums floating on its surface because it is washed away when the remainder of the molten metal is returned to the reservoir 119.

As soon as a pair of molds 6 is indexed with the pair of distribution ports 124 formed in the second tilted part 122, the casting cylinder 115 is actuated either manually or automatically to move the first tiled part 111 to its overflow position shown in dash-and-dot lines, so that the molten zinc continuously supplied to the first tilted part 111 from the molten zinc reservoir 119 through the feeding launder 117 is returned through the overflow opening 112 and the first returning launder 120 to the reservoir 119. Thus, the supply of molten zinc to the second tilted part 122 is interrupted. On the other hand, the cylinder 126 is actuated to move the second tilted part 122 to its distribution position shown in solid lines after the first tilting part 111 is moved to its overflow position as aforementioned. Thus, a predetermined volume of molten zinc is quickly and readily poured in each of the molds 6 indexed with the distribution ports 124 of the second tilted part 122.

Upon completion of casting, the second tilted part 122 is returned to its overflow position. Then, the first tilted part 111 is returned to its discharge position. Accordingly, molten zinc flows through the feeding launder 117 to the first tilted part 111, from which it moves to the second tilted part 122 and returns to the molten zinc reservoir 119 through the second returning launder 128, while a predetermined volume of molten zinc remains in the bottom portion of the second tilted part 122 as aforementioned, so that molten zinc is ready to be poured in the successive pair of molds 6 when the latter is brought into index with the pair of distribution ports 124. The aforementioned cycle of casting operation can be repeated automatically by controlling the operation of the cylinders 115 and 126 of the casting device (a) such that they are actuated when a pair of molds 6 is brought into index with the pair of distribution ports 124 formed in the second tilted part 122. This enables a predetermined volume of molten zinc to be cast quickly and readily in each of the molds 6.

The pair of molds 6 in which molten zinc is cast is conveyed by the chain conveyor 5 to the scum skimming device (b) shown in FIG. 8*a*, FIG. 8*b* and FIG. 8*c*. The scum skimming device comprises a movable frame 201 adapted to move horizontally, a slide frame 202 slidable with respect to the movable frame 201, a pair of dross scrape-up plates 203 secured to the slide frame 202 and adapted to pivotally move through a predetermined angle, a scrape-up plate guide frame 204 secured to the movable frame 201 and formed therein with an inclined slot 206 on each side of the frame, a pair of plate cams 205 secured to the slide frame 202, and another pair of scum scrape-up plates 207 cooperating with said plate cams 205 and the inclined slots 206 each receiving therein a pin 236.

When a pair of molds containing therein molten zinc cast by the casting device (a) is moved to a predetermined position, a limit switch (not shown) is actuated to actuate a scrape-up plate elevational cylinder 218 so as to thereby move a rack gear 219 in sliding motion. As a result, a pinion 215 maintained in meshing engagement with the rack gear 219 rotates through a predetermined angle, and a crank 216 also rotates through a predetermined angle. Rotation of the crank 216 moves the movable frame 210, through connecting rods 217, from a dash-and-dot line position to a solid line position shown in FIG. 8*a*. This moves the scrape-up plates 203 and 207 into the molten zinc in the respective molds 6 moving in the direction of an arrow.

Then, a scum skimming cylinder 220 is actuated so as to move in sliding motion the slide frame 202 relative to the respective movable frame 201 in the direction of movement of the molds 6 at a rate which is higher than the rate of movement of the molds 6. Thus, this scrape-up plates 203 slide along the surface of the molten zinc in the molds 6 to gather together the scum foaming on the surface of the molten zinc. A movable roller 210 on each of scrape-up plate guide plates 209 for plates 207 is maintained in pressing engagement with one of the plate cams 205 through a spring 211. Thus, as the plate cams 205 affixed to the slide frame 202 move, the movable rollers 210 are moved downwardly, so that the scrape-up plates 207 move downwardly deep into the molten zinc and at the same time slightly move counter clockwise in pivotal motion as the pins 236 move in the inclined slots 206 formed in the scrape-up plate guide frame 204.

At this time, the scrape-up plate 203 for one of the molds 6 is brought into engagement with the scrape-up plate 207 for the same mold 6 substantially in the middle portion thereof as the mold moves, with the scrape-up plate 203 slightly moving counter clockwise along the inclined scrape-up plates 207 and slightly moving upwardly away from the surface of the molten zinc. By this movement, the scrape-up plate 203 scoops the scum and at the same time squeeze out the molten zinc scooped by the scrape-up plate 203 together with the scum, so that the scooped molten zinc is returned to the respective mold. After the scrape-up plates 203 and 207 gather together the scum and at the same time the molten zinc caught by the scrape-up plates 203 and 207 is returned to the molds by the squeezing movement of the scrape-up plates 203 and 207 which move toward each other while the latter move in pivotal movement, the scrape-up plate elevational cylinder 218 is actuated and moves the scrape-up plates 203 and 207 in pressing engagement with each other above scum pushing-out means 212. Then, the scum skimming cylinder 220 is actuated to move the scrape-up plates 203 alone to their original positions. Thus, the scrape-up plates 203 and 207 are released from pressing engagement with each other, and the scum is released and dropped onto the dross push-out means 212.

The molds 6 are moved to forced cooling means (c) after the scum is removed therefrom by the scum skimming device (b). The forced cooling means (c) comprises a plurality of nozzles 9 (See FIG. 1) arranged equidistantly from one another along the path of movement of the molds 6 for blowing cooling water against the ingots. With the molds 6 being cooled by the cooling water ejected from the nozzles 9, the molten zinc in the molds solidify into ingots. Steam evaporated during the aforesaid operation is collected through hoods 10 (See FIG. 1) and vented to outside.

Then, the molds 6 are conveyed to the hammering device (d) disposed on the end of the chain conveyor 5 (see FIG. 1). As shown in detail in FIG. 9, the hammering device (d) comprises a plurality of hammer arms 301 and 302 pivotally connected at its base to a bracket 310 through a mounting pin 209 and each mounting hammer 304 at its end portion, a rotary disc 303 affixed to a sprocket wheel disposed on the end of the chain conveyor 5 and rotating as a unit therewith, and a plurality of arm pivoting rollers 305 and 306 mounted in the marginal portion of the rotary disc 303 by pins 311 and 307 respectively. The arm pivoting rollers 305 and 306 are adapted to raise the hammer arms 301 and 302 to a predetermined position. As the sprocket wheels rotate the chain conveyor 5, the rotary disc 303 affixed to the sprocket wheel on the end of the chain conveyor 5 and acting as a unit therewith also rotates and the arm pivoting rollers 305 and 306 move upwardly the hammer arms 301 and 302 respectively. As soon as the hammer arms are raised to the predetermined positions, the arms 301 and 302 are released from engagement with the arm pivoting rollers which arms drop downwardly at different times onto the molds at their underside to give an impact to each mold. This positively releases the ingots from the molds 6, with a result that a pair of ingots are arranged in a stacking table 23 of the ingot stacking device (See FIG. 2).

Preferably, an ingot stacks comprises twelve layers of ingots arranged in vertically stacked relation with the adjacent layers consisting of ingots arranged alternately in two different patterns or an A pattern and a B pattern shown in FIG. 13. The ingot stacks each comprising twelve layers of ingots are weighed and bound tightly for shipment. The ingots forming the lowermost layer of each ingot stacks have legs which are formed integrally by casting with the ingots to facilitate transportation and packing.

The ingot stacking device mainly shown in FIG. 3, FIG. 10, FIG. 11, FIG. 12 and FIG. 13 comprises a piling table 23 on which are placed the ingots 415 released from the molds 6, first hydraulic cylinder means 401 for horizontally moving a pair of ingots 415 resting on the stacking table 23, second hydraulic cylinder means 402 further moving horizontally the pair of molds 415 moved and arranged in a predetermined pattern by the first hydraulic cylinder means 401, ingot vertically moving hydraulic cylinder means 404 for arranging a set of four ingots 415 in a predetermined pattern of (B) type, a rotary machine 410 adapted to reverse the vertical position of each of the four ingots provided with legs for forming the lowermost layer of an ingot stacks so as to provide a layer of four ingots with legs arranged in another predetermined pattern of (A) type, rotary hydraulic cylinder means 405 cooperating with the rotary machine 410, and moving and stacking means 440 (See FIG. 2) adapted to place a set of four ingots arranged in one of said predetermined patterns on a discharge conveyor in a predetermined position and repeating this operation till the aforesaid ingot stack is formed.

The stacking table 23 is operatively connected to a cylinder (not shown) and capable of moving up and down. When in an uppermost position, the stacking table 23 receives thereon a pair of ingots 415 as shown in FIG. 11 after the ingots are released from the molds 6 disposed in side-by-side relation (See FIG. 10); when in a lowermost position, the stacking table 23 is flush with a frame 414 constituting a passageway for the ingots 415. As aforesaid, the stacking table 23 can be rotated through 90° by known means (not shown). The frame 414 is connected at one end to a bed 450 for forming a part of ingots arranged in the A pattern or a set of ingots arranged in the B pattern, and the ingot vertically moving hydraulic cylinder 404 is interposed between the bed 450 and the frame 414 for moving the ingots up and down through the agency of a pair of rollers 408.

Affixed to one end of the second hydraulic cylinder means 402 is a member 409 (See FIG. 11) which is adapted to be brought into engagement with a set of four ingots arranged in the A or B pattern on the bed 450 and moving the same to the moving and stacking means 440. The aforesaid rotary machine 410 is interposed between the bed 450 and moving and stacking means 440 and can be rotated through 180° by a rotary machine rotating hydraulic cylinder 405 through pillow blocks 411, a rack 412 and a pinion 413.

The moving and stacking means 440 (See FIG. 2) comprises a stacking case 506 for housing therein a set of four ingots arranged in the A or B pattern, a pull plate 508 disposed at the bottom of the stacking case 506 for directly supporting thereon a set of four ingots and movable horizontally by a cylinder 507 provided in the stacking case 506, and a cylinder 504 for moving the stacking case 506 up and down. The moving and stacking means 440 is supported on rails 510 for movement to the discharge conveyor means 460 (See FIG. 4) which constitutes a weighing and binding line, as a cylinder 509 is actuated.

The operation of the ingot stacking device constructed as aforementioned will now be described. Initially, two ingots 415 provided with legs are released from the two molds arranged in side-by-side relation on the chain conveyor 5 are placed on the stacking table 23 which is disposed in its uppermost position (See FIG. 10). At this time, the legs of the ingots are directed upwardly or the ingots are disposed upside down. Then, the stacking table 23 is moved downwardly by the cylinder to its lowermost position, and the first hydraulic cylinder means 401 is actuated to move the ingots 415 through a B stroke (See FIG. 11). At the end of this movement, the two ingots 415 spaced apart from each other on the stacking table 23 are brought into contact with each other by a tapering end portion of the frame 414. This operation is performed twice, so that a set of four ingots with legs arranged in the A pattern is formed.

Then, two ingots 415 with no legs are placed on the stacking table 23 (See FIG. 2). The stacking table 23 moves downwardly and at the same time rotates through 90°, so that the two ingots 415 on the stacking table 23 assume the positions of ingots B1 and B4 respectively of the B pattern. Upon the stacking table 23 stopping at its lowermost position, the first hydraulic cylinder means 401 is actuated to move the two ingots 415 through the B stroke. As the two ingots move forwardly, the preceding set of four ingots of the A pattern are moved forwardly onto the bed 450. Thereafter, the ingot vertically moving cylinder means 404 is actuated to move upwardly only the ingot 415 corresponding to the ingot B4 of the two ingots assuming the positions of the ingots B1 and B4 of the B pattern (See FIG. 10).

Still another pair of two ingots 415 released from the molds 6 is placed on the stacking table 23 which moves downwardly without rotating. The first hydraulic cylinder means 401 is actuated to move the two ingots 415 through an A stroke so as to arrange the ingots in positions corresponding to ingots B2 and B3 respectively of the B pattern. This is followed by the downward movement of the ingot vertically moving cylinder means 404 which places the ingot thereon in a position corresponding to the position of the ingot B4 of the B pattern. Thus, a set of four ingots arranged in the B pattern is formed. The aforementioned cycle of operation of forming a set of ingots of the A pattern and the cycle of operation of forming a set of ingots of the B pattern are repeated alternately.

The set of four ingots with legs arranged in the A pattern and resting on the bed 450 is moved by the second hydraulic cylinder means 402 through a D stroke, so that the set of ingots is placed in the rotary machine 410 which is rotated through 180° by the hydraulic cylinder 405 for rotating the rotary machine 410. The vertical position of the ingots with legs in the rotary machine 410 is reversed, with a result that the ingots are disposed in a normal condition with the legs being directed downwardly. While the rotary machine 410 is rotating, the ingots are kept stationary by members 417 provided within the rotary machine 410 (See FIG. 12), with the members 417 occupying upper positions as shown in FIG. 12 when the operation of reversing the vertical position of the ingots with legs is completed.

Then, the second hydraulic cylinder means 402 moves the set of four ingots with legs facing downwardly through a C stroke onto the pull plate 508 in the stacking case 506 (See FIG. 3). This is followed by actuation of the cylinder 504 for the moving and stacking means 440 to move the stacking case 506 upwardly. Thereafter, cylinder 509 is actuated to move the moving and stacking means 440 on the rails 510 to a position which is disposed on one end of the discharge conveyor means 460 constituting the weighing and binding line.

Cylinder 504 is actuated again to move the stacking case 506 downwardly. When the stacking case 506 reaches a predetermined height above a plate for stacking which is provided in the conveyor means, a limit switch (not shown) provided in the stacking case is in contact with the plate to thereby de-actuate cylinder 504 and actuate cylinder 507. Thus, the pull plate 508 moves outwardly in sliding motion and one set of ingots is moved from the stacking case to a predetermined position on the conveyor means 460.

The next following set of ingots arranged in the B pattern on the bed 450 is moved through the C stroke by the second hydraulic cylinder means 402 and placed in the stacking case 506 in the same manner as aforesaid. Since the ingots of this set have no legs and are therefore lower in height than the ingots with legs, they move through the rotary machine 410 without coming into contact with the members 417 within the rotary machine 410.

Then, the moving and stacking means 440 operates in the same manner as aforesaid. When the limit switch contacts with the surface of the previously set ingots with legs the limit switch is actuated, so that the next following set of ingots arranged in the B pattern is stacking on the preceding set of ingots of the A pattern with legs. The aforementioned operation is repeated so as to form an ingot stack comprising twelve sets or layers of ingots alternately arranged in the A and B patterns. The ingot stack is then conveyed to the weighing device (e) by the conveyor means 460 (See FIG. 4).

The weighing device (e) for weighing the ingot stack 601 placed on the discharge conveyor means 460 are shown in detail in FIG. 14, FIG. 15 and FIG. 16. The weighing device comprises a gate-shaped framework 605 which surrounds the conveyor means 460. A weighing means 606 of a known type is mounted on the top of the framework 605.

As is well known, the weighing means 606 comprises a base plate 607 which has mounted on the surface of its central portion a lifting cylinder 608 receiving therein a piston connected to a piston rod 609 (See FIG. 15) which extends downwardly through an opening 610 formed in the base plate 607. The piston rod 609 further extends through a center opening 611 formed in the weighing means 606.

The rod 609 connected to the lifting cylinder 608 is connected at its lower end to the center of a transverse arm 612 which supports at opposite ends guide bar supports 613 which in turn support guide bars 614 therebetween.

Each guide bar 614 slidably supports grip arms 615 (See FIG. 16) arranged in face-to-face relation and connected to the rod side and head side respectively of a grip cylinder 616. Thus, as the grip cylinder 616 moves in telescopic motion, the grip arms 615 move toward or away from each other widthwise of the discharge conveyor means 460, so that the grip arm 615 can be brought into or out of engagement with the ingot stack 601.

An upwardly extending slide bar 618 is provided at front and rear ends of each guide bar support 613. The slide bars 618 extend through openings 619 formed in the weighing means 606 and are received in sliding openings 620 formed in the base plate 607.

In operation, upon the ingot stack 601 being brought by the discharge conveyor means 460 to a weighing position in which the ingot stack is adapted to be engaged by the grip arms 615, a suitable limit switch known in the art senses the movement of the ingot stack to such position and the movement of the discharge conveyor means 460 is interrupted. Then, the grip cylinder 616 is telescopically contracted to move the grip arms 615 toward each other so as to engage the bottom of the ingot stack 601. Thereafter, the lifting cylinder 608 is actuated to move the rod 609 upwardly. Accordingly, the guide bar supports 613 move upwardly while being guided by the upwardly extending slide bars 618, thereby lifting the grip arms 615. This releases the ingot stack 601 from engagement with a support bar 603 on the discharge conveyor means 460, so that the weighing means 606 can measure the weight of the ingot stack 601.

Upon completion of weighing of the ingot stack 601, the lifting cylinder 608 is actuated again to move the rod 609, and hence the grip arms 615, downwardly so as to place the ingot stack 601 on the support bar 603 on the discharge conveyor means 460. Finally, the grip cylinder 616 is telescopically expanded to move the grip arms 615 away from each other. Then, the ingot stack 601 just weighed can be moved by the conveyor means and the next following ingot stack 601 can be weighed. The weight of each ingot stack determined by the weighing device is supplied in the form of a signal by known means (not shown) to a printer for printing on a recording sheet.

Upon completion of weighing of the ingot stack 601 by the weighing device (e), the limit switch is actuated to start the operation of the discharge conveyor means 460 again to move the weighed ingot stack to the binding device (f) shown in FIG. 4 and more in detail in FIG. 17 and FIG. 18. The ingot binding device (f) comprises four posts 701 which are supported at their lower ends by a lower frame 703 secured to a plurality of bases 702. The posts 701 are firmly interconnected at their upper ends by an upper frame 704. In the embodiment shown, the discharge conveyor means 460 extends between the two adjacent posts 701. The discharge conveyor means 460 may be of known construction and comprises, a support plate 603 on which are placed legged ingots 707 forming the undermost layer of the ingot stack 601 to be bound together.

The support plate 603 secured to an upper run 709 of the conveyor means 460 is supported upon the top faces of support members 710, which support plate 603 slides upon said top faces of the support member 710 when said upper run 709 is moved. The support members 710 are mounted on the lower frame 703.

As shown in FIG. 17 and FIG. 18, a hydraulic pressure ram means 711 is mounted on the upper frame 704 and includes an operation rod 712 which extends vertically downwardly and has a ram frame 713 connected to its lower end. The ram frame 713 is slidably fitted on the posts 701 and guided thereby in its vertical movement. Mounted at the underside of the ram frame 713 is a pressing member 714 which is adapted to be brought into pressing engagement with the top of the ingot stack 601 to be bound together.

Mounted on the lower frame 703 is a chute support member 716 which supports a fixed chute 717 disposed above the conveyor means 460 and widthwise thereof. The fixed chute is substantially in the form of an inverted letter U, and a binding head subsequently to be described is connected to one side of the fixed chute 717 which is disposed opposite to the chute support member 716.

Two side frames 720 extending transversely are also mounted on the lower frame 701, with each side frame 720 supporting a slide base 721. A hydraulic cylinder 722 is mounted on each slide base 721. A chute support 724 supporting a movable chute 723 is secured to the rod of each hydraulic cylinder 722. The chute supports 724 are capable of moving in sliding motion on the respective slide bases 721. Thus, upon actuation of the hydraulic cylinders 722, the two movable chutes 723 can be moved between a solid line position in which they are disposed under the legged ingots 707 forming the lowermost layer of the ingot stack 601 to be bound together to thereby cooperate with the fixed chute 717 in forming a guideway completely surrounding the ingot stack 601 as shown in FIG. 17 and a standby position shown in dash-and-dot lines in which the movable chutes 723 are withdrawn to opposite sides of the conveyor means 460 to permit the ingot stack 601 to move freely because of the run of the conveyor means 460.

The binding head 725 referred to above is mounted on one of the slide bases 721 and can be moved by a hydraulic cylinder 726 between a position in which it is in alignment with the guideway formed by the fixed chute 717 and the movable chute 723 as shown in FIG. 17 and a position in which it comes into contact with one side of the ingot stack 601. The hydraulic cylinder 726 is secured to a suitable immovable member 727 of the machine.

A steel band 729 for tightly binding the ingot stack 601 together is supplied from a dispenser 728 to the binding head 725, and its leading end is guided by the movable chute 723 and the fixed chute 717 before returning to the binding head 725.

Although not shown, two sets of movable and fixed chutes 717 and 723 and the binding heads 725 may be provided along the discharge conveyor means 460 so as to tightly bind the ingot stack 601 in different positions as shown in FIG. 18. Also, another hydraulic cylinder for moving the set of binding elements may be provided so as to move the set along the conveyor means 460 in such a manner that said set of binding elements carrying out the binding at positions 732 and 733 can effect such binding at other position 734 and 735.

As shown in FIG. 18, the ram frame 713 has mounted thereon a stamping machine 730 which stamps the ingot stack 601 to provide thereon the weight and other information of the stack. In order to preclude collapsing of the ingot stack 601 by the pressure applied thereto when the stamping is effected, backup means 731 is provided and located opposite the stamping machine 730 with respect to the ram frame 713 so as to exert a force on the ingot stack simultaneously as the stamping machine 730 is actuated. The stamping machine 730 and backup means 731 may be hydraulically operated as is known.

When the ingot stack 601 including the lowermost layer consisting of legged ingots 707 and resting on the support plate 603 of the discharge conveyor means 460 is fed to the binding device and stops in a predetermined position, the support plate 603 is positioned on the support members 710. Whereupon the hydraulic ram means 711 is actuated to move the ram frame 713 downwardly to exert a great force on the top of the ingot stack 601 from above through the pressing member 714. This brings all the layers of ingots of the ingot stack 601 into intimate contact with each other, so that no loosening of the ingots occurs after the ingot stack is bound. In this embodiment, the pressure applied by the ram means 711 is 150 kg/cm$^2$, which pressure is of course varied in accordance with the variation of casting fins, the quality of material of binding steel and the state of metal to be treated.

In the embodiment shown and described, the metal is zinc. The zinc ingots moved by the conveyor means 460 to the binding device has a temperature in a range from 200° to 250°C. By applying pressure to the ingot stack by the hydraulic ram means 711, the spacing between the layers of ingots of the stack is minimized by the deformation of fins and elimination of buckling of the ingots. Moreover, irregularities on the surfaces of the ingots can be removed and the influence of thermal contraction can be cancelled out. Since the ingots are at elevated temperature, cracks do not occur on the surface of each ingot which are visible to the naked eye. However, if the metal ingots are at normal temperature, cracks may be formed by the application of pressure. In case the formation of cracks raises no problem, the ingot stack may be pressed and bound when the ingots are at normal temperature.

After pressure is applied to the ingot stack 601, the movable chute 723 in its standby position is moved inwardly to form the steel band guideway by the cylinder 722, the binding head 725 feeds the steel head 729 along the guideway formed by the chutes 711 and 723 as shown in FIG. 17 and receives its leading end which returns to the heat 725 after moving along the passageway. Then, the hydraulic cylinder 726 is actuated to move the binding head 725 to the position in which it is in contact with one side of the ingot stack 601. In this position, the binding head 723 tightens the steel band 729 which is released from the chutes 711 and 723 and tightly binds and seals the ingot stack 601.

After the input stack 601 is bound with the steel band 729, the steel band 729 is cut and the binding head 725 is returned to the position shown in FIG. 17. When only one binding device is used as shown, the binding head 725 may be moved by another hydraulic cylinder (not shown) of known construction along the conveyor means 460 lengthwise thereof, so that the binding operation can be performed three more times to bind the ingot stack 601 in a direction which is across the width of the conveyor means 460 as shown in FIG. 18.

Upon completion of binding, the weight, quality marks and other indication are formed on the ingot stack 601 by the stamping machine 730. Then, the discharge conveyor means 460 is rendered operative again to forward the bound and stamped ingot stack 601 to the next following operation station where it is transferred to a forklift or other means for transportation to a desired destination.

From the foregoing description, it will be appreciated that the method and apparatus according to the invention permit processing of the molten metal through successive steps beginning with casting of ingots and ending with binding to be carried out automatically and continuously. The invention enables to greatly increase the efficiency with which a series of steps including casting molten metal in molds to produce ingots and forming the ingot into ingot stack are carried out.

We claim:

1. A method of continuously and automatically producing stacks of nonferrous metal ingots, comprising the steps of:

casting a predetermined volume of molten metal by a constant volume casting device in molds set on chain conveyor means;

producing ingots by driving the chain conveyor means by first moving the molds to a scum skimming device for skimming from the molten metal in each mold scum which foams to its surface and then moving the molds to cooling means for cooling the ingots;

releasing the ingots from the molds and forming the ingots into an ingot stack disposed on another conveyor means, said stack comprising a plurality of layers of ingots arranged in a vertically stacked relation with the ingots of the adjacent layers being arranged in two different patterns;

weighing the ingot stack by a weighing device after conveying the ingot stack to a weighing position by driving said last mentioned conveyor means;

driving said last mentioned conveyor means with said ingot stack thereon to a binding position after weighing is finished;

applying pressure to said ingot stack using a hydraulic pressing means to flatten said ingots; and binding said ingot stack using a binding device.

2. A method as claimed in claim 1 characterized in that said step of casting a predetermined volume of molten metal is carried out by cooperation between a first tilted part pivotally movable to have an overflow position for returning molten metal to a molten metal reservoir or a discharge position in which molten metal is discharged therefrom and a second tilted part operatively associated with said first tilted part, said first tilted part returning scum and molten metal through an overflow opening to the molten metal reservoir while molten metal is being poured into the molds from the second tilted part, and said first tilted part moving to the position in which it pours molten metal into the second tilted part when the latter is in an overflow position, whereby a constant volume of molten metal substantially free from scum can be poured in each mold.

3. A method as claimed in claim 1 characterized in that scum foaming on the surface of the molten metal in each mold after the former is cast in the latter is skimmed by means of two scrape-up plates adapted to be introduced into the molten metal in each mold, one scrape-up plate being movable relative to the mold and the other scrape-up plate being movable in pivotal motion, the two scrape-up plates being disposed in positioned remote from each other and moved toward each other when a scum skimming operation is performed.

4. A method as claimed in claim 1 characterized in that the release of the ingots from the molds is positively effected by applying an impact to each mold by causing a hammering device mounted on the first mentioned conveyor means to strike against the underside of each mold.

5. An apparatus for continuously and automatically effecting a series of steps beginning with casting of molten nonferrous metal in molds to cast ingots and ending with binding of ingot stacks comprising:

an automatic casting machine for casting molten metal in molds to continuously produce ingots, said casting machine comprising:

a plurality of molds set on chain conveyor means;

a casting device for casting a constant volume of molten metal in each mold comprising:

a first tilted part formed at one end with a discharge port and at the other end with an overflow opening and capable of pivotally moving vertically between a discharge position and an overflow position;

a second tilted part arranged below said discharge port of said first tilted part and capable of pivotally moving vertically between a distribution position and an overflow position, said second tilted part being formed at one end with a plurality of distribution ports and at the other end with an overflow opening;

supply means for continuously supplying molten metal to said first casting tilted part from a molten metal reservoir;

actuating means for pivotally moving each of said first tilted part and said second tilted part between said two positions; and return means for receiving molten metal through the overflow openings of said first tilted part and said second tilted part when said two parts are in their respective overflow positions and returning the molten metal to the molten metal reservoir, said first tilted part being disposed in the discharge position when said second tilted part is in the overflow position and said first tilted part being pivotally moved to the overflow position before said second tilted part is pivotally moved to the distribution position;

a scum skimming device for skimming scum foaming to the surface of the molten metal cast in each mold;

cooling means for forcedly cooling the molten metal in the molds to forcedly cool the ingots; and a hammering device for releasing the ingots from the molds, said devices and means all operatively associated with said chain conveyor means;

an ingot stacking device for stacking the ingots released from the automatic casting machine to form the ingots into an ingot stack disposed on conveyor means and comprising a plurality of layers of ingots arranged in vertically stacked relationship;

a weighing device for weighing the ingot stack conveyed by said conveyor means; and a binding device for binding the ingot stack weighed by said weighing device.

6. An apparatus for continuously and automatically effecting a series of steps beginning with casting of molten nonferrous metal in molds to cast ingots and ending with binding of ingot stacks comprising:

an automatic casting machine for casting molten metal in molds to continuously produce ingots, said casting machine comprising:

a plurality of molds set on chain conveyor means;

a casting device for casting a constant volume of molten metal in each mold;

a scum skimming device for skimming scum foaming to the surface of the molten metal cast in each mold, said scum skimming device comprising:

a movable frame capable of moving horizontally;

a slide frame movable in sliding motion with respect to said movable frame;

a pair of scrape-up plates connected to said slide frame and each being capable of pivotally moving through a predetermined angle;

a scrape-up plate guide frame secured to said movable frame and formed therein with a plurality of inclined slots each receiving therein a pin;

a plurality of plate cams affixed to said slide frame; and another pair of scrape-up plates each adapted to operate in cooperation with one of said plate cams and one of said slots formed in the scrape-up plate guide frame and receiving the pin therein for pivotal movement through a predetermined angle, one of said first pair of scrape-up plates being adapted to come into engagement with one of said second pair of scrape-up plates;

cooling means for forcedly cooling the molten metal in the molds to forcedly cool the ingots; and a hammering device for releasing the ingots from the molds, said devices and means all operatively associated with said chain conveyor means:

an ingot stacking device for stacking the ingots released from the automatic casting machine to form the ingots into an ingot stack disposed on conveyor means and comprising a plurality of layers of ingots arranged in vertically stacked relationship;

a weighing device for weighing the ingot stack conveyed by said conveyor means; and a binding device for binding the ingot stack weighed by said weighing device.

7. An apparatus for continuously and automatically effecting a series of steps beginning with casting of molten nonferrous metal in molds to cast ingots and ending with binding of ingot stacks comprising:

an automatic casting machine for casting molten metal in molds to continuously produce ingots;

an ingot stacking device for stacking the ingots released from the automatic casting machine to form the ingots into an ingot stack disposed on conveyor means and comprising a plurality of layers of ingots arranged in vertically stacked relationship, said stacking device comprising:

a stacking table adapted to receive thereon a plurality of ingots released from the molds, said stacking table being capable of moving up and down and rotating through a predetermined angle;

means for moving the plurality of ingots on said stacking table to a bed after arranging the same in a predetermined pattern; and moving and stacking means for forwarding a set of ingots from said bed to a predetermined position and stacking the ingots so as to form in a predetermined position on the conveyor means an ingot stack comprising a plurality of layers of ingots arranged in vertically stacked relationship with the ingots of the adjacent layers being arranged in two different patterns:

a weighing device for weighing the ingot stack conveyed by said conveyor means; and a binding device for binding the ingot stack weighed by said weighing device.

8. An apparatus for continuously and automatically effecting a series of steps beginning with casting of molten nonferrous metal in molds to cast ingots and ending with binding of ingot stacks comprising:

an automatic casting machine for casting molten metal in molds to continuously produce ingots;

an ingot stacking device for stacking the ingots released from the automatic casting machine to form the ingots into an ingot stack disposed on conveyor means and comprising a plurality of layers of ingots arranged in vertically stacked relationship;

a weighing device for weighing the ingot stack conveyed by said conveyor means, said weighing device comprising:

a frame through which the conveyor means extends;

weighing means mounted on said frame;

gripping means adapted to be brought into engagement with the ingot stack on the conveyor means for gripping the same; and lifting means capable of moving upwardly away from the conveyor means said gripping means and the ingot stack gripped thereby; and a binding devoce for binding the ingot stack weighed by said weighing device.

9. An apparatus for continuously and automatically effecting a series of steps beginning with casting of molten nonferrous metal in molds to cast ingots and ending with binding of ingot stacks comprising:

an automatic casting machine for casting molten metal in molds to continuously produce ingots;

an ingot stacking device for stacking the ingots released from the automatic casting machine to form the ingots into an ingot stack disposed on conveyor means and comprising a plurality of layers of ingots arranged in vertically stacked relationship;

a weighing device for weighing the ingot stack conveyed by said conveyor means; and a binding device for binding the ingot stack weighed by said weighing device, said binding device comprising:

a support member for supporting the ingot stack;

pressing means disposed in spaced juxtaposed relation with said support member and adapted to apply pressure to the ingot stack resting on said support plate;

chute means surrounding the ingot stack for guiding a steel band for binding the ingot stack; and a binding head adapted to tighten said steel band to bind and seal the ingot stack.

* * * * *